US008398014B2

(12) United States Patent
Andersson

(10) Patent No.: US 8,398,014 B2
(45) Date of Patent: Mar. 19, 2013

(54) SOLID ROLL PROVIDED WITH AT LEAST ONE ADAPTER AND ADAPTER FOR A SOLID ROLL

(75) Inventor: Anders Andersson, Stenungsund (SE)

(73) Assignee: SCA Hygiene Products AB, Gothenburg (SE)

( * ) Notice: Subject to any disclaimer, the term of this patent is extended or adjusted under 35 U.S.C. 154(b) by 0 days.

(21) Appl. No.: 11/024,444

(22) Filed: Dec. 30, 2004

(65) Prior Publication Data

US 2005/0139721 A1 Jun. 30, 2005

Related U.S. Application Data

(60) Provisional application No. 60/532,901, filed on Dec. 30, 2003.

(51) Int. Cl.
*B65H 16/06* (2006.01)

(52) U.S. Cl. ..... 242/596.7

(58) Field of Classification Search ..... 242/596, 242/596.7, 598, 599.4, 160.1, 596.1, 596.4, 242/588.6; 312/34.8
See application file for complete search history.

(56) References Cited

U.S. PATENT DOCUMENTS

| | | | | |
|---|---|---|---|---|
| 1,408,126 | A * | 2/1922 | Mumm | 242/596.7 |
| 3,106,362 | A | 10/1963 | Sukala, Jr. | |
| 4,013,236 | A | 3/1977 | Perrin | |
| 4,905,923 | A * | 3/1990 | Dudley | 242/588.6 |
| 5,277,375 | A * | 1/1994 | Dearwester | 242/596.7 |
| 5,281,386 | A | 1/1994 | Weinert | |
| 5,370,339 | A | 12/1994 | Moody et al. | |
| 5,495,997 | A | 3/1996 | Moody | |
| 5,501,415 | A * | 3/1996 | Harris et al. | 242/596.7 |
| 5,620,148 | A | 4/1997 | Mitchell | |
| 5,839,680 | A * | 11/1998 | Biagiotti | 242/160.1 |
| 5,868,342 | A | 2/1999 | Moody et al. | |
| 6,036,134 | A * | 3/2000 | Moody | 242/422.4 |
| 6,082,664 | A * | 7/2000 | Phelps et al. | 242/596.5 |
| 6,386,479 | B1 * | 5/2002 | Lewis et al. | 242/596.8 |
| 6,409,120 | B1 | 6/2002 | Tramontina et al. | |
| 6,592,068 | B2 | 7/2003 | Taylor et al. | |
| 7,066,423 | B2 * | 6/2006 | Andersson | 242/599.3 |

FOREIGN PATENT DOCUMENTS

| | | |
|---|---|---|
| EP | 0 580 561 | 1/1994 |
| EP | 1 268 330 | 1/2003 |
| WO | WO 99/60909 | 12/1999 |
| WO | WO 03040012 | 5/2003 |
| WO | WO 2004/056250 | 7/2004 |

* cited by examiner

*Primary Examiner* — William E Dondero
(74) *Attorney, Agent, or Firm* — Young & Thompson

(57) ABSTRACT

A solid roll (1) of flexible web-shaped material, such as paper or nonwoven material, being provided with at least one adapter (6). The adapter (6) includes first attachment element (7) for attachment to the solid roll (1) and second attachment element (8) for attachment to a dispenser. The first attachment element (7) comprises at least one elongated attachment member (9), which is adapted to be arranged extending in or near the center line (5) of the solid roll (1). Furthermore, the at least one elongated attachment member (9) is arranged to fixate the adapter (6) to the flexible web-shaped material of the solid roll (1) through frictional engagement.

21 Claims, 6 Drawing Sheets

SOLID ROLL PROVIDED WITH AT LEAST ONE ADAPTER AND ADAPTER FOR A SOLID ROLL

CROSS-REFERENCE TO RELATED APPLICATION

This application claims the 35 USC 119(e) benefit of prior U.S. Provisional application 60/532,901 filed on Dec. 30, 2003, whose entire contents are expressly incorporated by reference

TECHNICAL FIELD

The present invention relates to a solid roll of flexible web-shaped material, such as paper or non-woven material, provided with at least one adapter, which solid roll is suited for installation and holding in various types of conventional dispensers and is ready to be loaded in a dispenser at delivery to the end consumer without the need of adding and fitting any extra adaptation parts. Furthermore, the invention relates to an adapter for a solid roll, an adapter combination for a solid roll and a dispenser for holding a solid roll according to the invention.

BACKGROUND OF THE INVENTION

Commercial and consumer products of flexible web-shaped material, such as toilet paper, hand towel paper, kitchen towel paper, industrial wiping paper and nonwoven wiping material, are typically distributed and dispensed in roll form. Small rolls with a diameter of 100 to 150 mm are normally used in households, whereas larger rolls, which often are called jumbo rolls and which can have a diameter of 200 to 400 mm, are utilized in commercial uses, i.e. in offices and in public washrooms etc. The jumbo rolls carry much more flexible web-shaped material than the small household rolls and are correspondingly much heavier. The small household rolls weigh 0.1-0.2 kg and the jumbo rolls weigh from 0.2 to 8.0 kg or even 10 kg and can carry 1500 m of flexible web-shaped material.

Today there are different types of rolls, such as cored rolls, coreless rolls and solid rolls, on the market. These types of rolls have different characteristics, which will be further described below. Traditionally, the cored roll has been predominant on the market, whereas new market trends have introduced the coreless roll as well as the solid roll.

The cored roll, which traditionally has been utilized, is typically produced on a hollow cylindrical core, around which the flexible web-shaped material is rolled up. For example, the hollow cylindrical core may be made of some type of cardboard or plastic material. After finished production, the hollow cylindrical core remains in the cored roll. Thus, the cored roll intended for the end consumer comprises the hollow cylindrical core defining a hollow space at the centre of the roll.

The coreless roll, which has been introduced by new market trends, does not comprise any hollow cylindrical core around which the flexible web-shaped material is wound. However, the coreless roll comprises an opening extending through the centre of the roll. The coreless roll is produced on some type of mandrel belonging to the production equipment. The flexible web-shaped material is rolled up around the mandrel to form the roll and the mandrel is subsequently extracted and recycled after finished up-rolling. During extraction of the mandrel from the roll, an opening is created through the roll. The opening may collapse and assume a deformed shape, such as oval, flattened or star-shaped, during or after withdrawal of the mandrel, but the coreless roll intended for the end consumer still comprises an opening at the centre of the roll. The innermost windings of web-shaped material are normally attached to each other by addition of some water in order to act like a core. However, the central opening of the coreless roll is much smaller in diameter than the diameter of the core of the cored roll. One consequence thereof is, for example, that the coreless roll may comprise more flexible web-shaped material than the cored roll for a given outer diameter. A machine and method for the production of coreless rolls are, for example, described in EP 1268330.

The solid roll, which has been introduced recently on the market, does not comprise any hollow cylindrical core and neither any opening extending through the centre of the roll. The solid roll is not produced on any core, mandrel or the like, but even the innermost part of the roll is filled with flexible web-shaped material during production of the roll. The finished solid roll takes on the appearance of a compact cylinder completely filled with flexible web-shaped material and is essentially homogenous in a cross-section viewed from the side. The density range of the solid roll is 140-380 kg/m$^3$. However, there may be some deviation from the homogenous characteristic due to, for example, technical reasons during manufacturing or due to that a deviation is desired in the centre area. The density range of a centre part having a diameter of 10 mm may, for example, be between 20 kg/m$^3$ less than the other parts of the roll and 20 kg/m$^3$ more than the other parts of the roll. The density of the centre part having a diameter of 10 mm may be measured by unwinding a solid roll such that the remaining part of the solid roll has a diameter of 10 mm and thereafter measuring the volume and weight of the remaining part of the solid roll. Since the solid roll does not have any core or opening at the centre of the roll, the solid roll may comprise more meters of flexible web-shaped material for a given outer diameter compared to the cored and coreless rolls. A machine and method for the production of solid rolls are, for example, described in EP 0580561.

The core of cored rolls has to be taken away and discarded when all flexible web-shaped material has been used. The coreless and solid rolls are more environment friendly than the cored roll since all flexible web-shaped material of the coreless or solid rolls may be used and since they have no core that has to be discarded. In addition, cored rolls are more expensive to manufacture than coreless and solid rolls because of the expense of producing the cores and joining the product to the core.

However, since cored rolls traditionally have been utilized, conventional dispensers used by consumers today are generally suited for cored rolls only. Many conventional dispensers comprise, for example, a spindle or the like on which the roll is to be mounted in a manner similar to ubiquitous bathroom toilet roll dispensers. Such a spindle is arranged to pass through or otherwise penetrate the inner space of the core of the cored roll such that the cored roll may rotate around the spindle. For example, the spindle may be a member of the dispenser being affixed to the dispenser at one end or may be a releasable member of the dispenser being adapted to be inserted into slots, pathways or the like defined in the sides of the dispenser.

Since solid rolls have no opening extending through the roll, a solid roll is not suited for loading in dispensers for cored rolls comprising a spindle or the like to be inserted through the roll. Furthermore, since the central opening in coreless rolls might have assumed a deformed shape, since the diameter of the central opening is less than the diameter of the core of cored rolls and since the diameter of the central opening can vary with air moisture content, it may be difficult to fit a coreless roll into such dispensers. Furthermore, there is a risk that a coreless roll wobbles in such dispensers as material is drawn from the roll.

One way to enable installation and holding in a dispenser of a coreless roll or a solid roll, respectively, is to utilize a dispenser that is specifically configured during its manufacture for loading coreless and/or solid rolls.

One example of a type of dispenser that is specifically configured for holding coreless or solid rolls, respectively, is a disperser having the shape of a trough in which the roll is put. The flexible web-shaped material is fed over the upper edge of the trough or through a slit in the lower part. However, when there is only a few windings left of the solid roll, it might be difficult to get hold of the end of the flexible web-shaped material in such a dispenser and the user may have to pick up the solid roll to find the end of the flexible web-shaped material.

Another example of a type of dispenser that is specifically configured for holding solid rolls is a dispenser that comprises a projection part on at least one dispenser side. Such a dispenser is, for example, disclosed in WO 2004056250. The projection part may be a pin or the like. When a new solid roll is loaded in such a dispenser, the projection part is forced to penetrate between windings of the solid roll. However, in order to be able to use as much as possible of the material of the solid roll, the projection part must be forced to penetrate at or near the innermost winding. Thus, the user has to try to fit the solid roll to the projection part such that it penetrates at or near the innermost winding. Furthermore, it is required that some force is applied for the penetration.

Another way to enable installation and holding in a dispenser of a coreless roll or a solid roll, respectively, is to adapt an existing dispenser for cored rolls for loading coreless or solid rolls, respectively, and/or to adapt coreless or solid rolls, respectively, to fit to such a dispenser.

One way, which is well-known in the art, of adapting a coreless or solid roll for installation and holding in a dispenser for cored rolls comprises creation of a depression in each vertical side of a coreless roll or a solid roll, respectively, at the time of production and provision of an adapter that fits both into the depression and to a mounting structure of the dispenser. A method of producing a depression in a vertical side of a roll is, for example, disclosed in U.S. Pat. No. 5,620,148.

WO 99/60909 discloses an adapter for converting a dispenser for a small cored roll into a dispenser for a small coreless roll. The adapter comprises a plunger arranged to extend from one of the sides of the dispenser and fit into a depression in a side of a coreless roll. Furthermore, the adapter comprises attachment means for securing the adapter to a core roll product dispenser. A depression is preferably provided in each side of the coreless roll at the time of production.

U.S. Pat. No. 6,082,664 discloses an adapter for small solid or coreless rolls of paper material, in which rolls there are recesses or divots defined in the vertical sides of the rolls. The adapter is to be placed in a dispenser for cored rolls, in which dispenser there are slots defined in the sides of the dispenser. The recesses, which should be formed at the time of production, define a rotating axis for the coreless or solid roll and a protrusion extending from the adapter is arranged to be pressed into one of the recesses. An engaging member may extend substantially transverse from the adapter and may be insertable into and slidable along the slots in the sides of the dispenser. A pair of adapters may engage and hold the roll therebetween within the dispenser.

U.S. Pat. No. 6,592,068 discloses an adapter for small solid or coreless rolls of paper material, in which rolls there are recesses or divots defined in the vertical sides of the rolls. The adapter is to be placed in a dispenser for cored rolls, in which dispenser there are slots defined in the sides of the dispenser. The adapter includes a carriage having opposite side members attached to a transverse support arm. A protrusion is formed on one side of each side member, which protrusion is intended to at least partially engage into the recess in a vertical side of the solid or coreless roll. A pin is disposed on the other side of each side member and is intended to engage in one of the slots in the sides of the dispenser.

However, in order to enable installation and holding of coreless or solid rolls, respectively, in a dispenser for cored rolls by use of the adapters according to WO 99/60909, U.S. Pat. No. 6,082,664 and U.S. Pat. No. 6,592,068, respectively, the rolls must be provided with a depression in each of their vertical sides. In use, the user has to fit those adapters, respectively, into both the depressions in the sides of the rolls and to the dispensers and ensure that reliable fitting is achieved to both the roll and the dispenser. Thus, some workload is then put on the user. Furthermore, the adapters according to U.S. Pat. No. 6,082,664 and U.S. Pat. No. 6,592,068, respectively, are only possible to use in dispensers having slots or the like defined in their side walls.

Another way, which is known in the art, of adapting a coreless roll having a central aperture for loading in a dispenser for cored rolls comprises utilization of an adapter that is intended to be inserted into the aperture and to be attached to such a dispenser.

U.S. Pat. No. 5,495,667 discloses a support spindle apparatus, which is intended to be inserted into the central aperture of a coreless toilet tissue roll to support the coreless roll in a toilet tissue dispenser cabinet of the type having opposed, elongated, generally vertically oriented guide slots. The support spindle apparatus comprises an elongated spindle body having a generally cruciform cross-section over most of its length. In use, the spindle apparatus is inserted into the aperture of a coreless roll such that one end is positioned outside the roll on one side of the roll and the other end is positioned outside the roll on the opposite side of the roll. Thereafter, one end of the spindle apparatus may be inserted into a slot at one side of a dispenser and the other end of the spindle apparatus may be inserted into a slot in the opposite side of the dispenser. The support spindle apparatus further comprises a roll stop element fixedly attached to the elongated spindle body to prevent movement of the roll relative to the spindle apparatus in a single direction.

U.S. Pat. No. 5,868,342 describes a roll spindle intended to be used in modification of a multi-roll dispenser normally used to dispense tissue from rolls of toilet tissue having centre cores to dispense tissue from coreless rolls. One spindle is inserted into each roll in the multi-roll dispenser. The spindle comprises a spindle shaft and a plurality of roll engagement elements rotatably journaled on the spindle shaft. Furthermore, the spindle has a tapered distal end and the spindle is inserted into a roll with the tapered end first. At the other end of the spindle, a mounting member is provided for affixing the spindle to the dispenser. During use, the coreless roll may be rotated around the spindle shaft by means of the rotatably journaled roll engagement members, whereas the spindle shaft is fixed in position, i.e. not rotated.

However, in order to enable installation and holding of coreless rolls in a dispenser for cored rolls by use of the spindles according to U.S. Pat. No. 5,495,667 and U.S. Pat.

No. 5,868,342, respectively, the user has to fit those spindles, respectively, to the aperture of a coreless roll. Since the aperture in a coreless roll may have collapsed and assumed a deformed shape, as mentioned above, it might be tricky and time-consuming to fit such a spindle to the aperture and to avoid that windings of web-material are penetrated during insertion of such a spindle. Furthermore, the spindles according to U.S. Pat. No. 5,495,667 and U.S. Pat. No. 5,868,342, respectively, are only suited for rolls having a central aperture, such as coreless rolls, whereby they are not suited for solid rolls.

Furthermore, the spindle apparatus according to U.S. Pat. No. 5,868,342 may only be used in a special type of dispenser.

Therefore, there is still a need for a simple and reliable way of achieving the possibility to install and hold solid rolls of flexible web-shaped material in a dispenser such that flexible web-shaped material may be dispensed in a reliable and user-friendly way. Furthermore, there is a need for the possibility to achieve solid rolls of flexible web-shaped material that are adapted for enabling installation and holding in various types of dispensers that hold a roll in its central line. There is also a need for the possibility to achieve solid rolls that are adapted such that they are ready to be used in a dispenser at delivery, i.e. without the user having to add any adaptation parts.

SUMMARY OF THE INVENTION

Accordingly, it is an object of the present invention to provide an improved and simplified way of enabling use of solid rolls.

This object is achieved through a solid roll of flexible web-shaped material, such as paper or non-woven material, which solid roll has two opposite sides, an envelope surface between the two sides and a centre line, and which solid roll is provided with at least one adapter comprising:

first attachment means for attachment to the solid roll, the first attachment means being adapted to be arranged extending into the solid roll from one of the sides, and second attachment means for attachment to a dispenser, the second attachment means being adapted to be arranged enabling attachment to a dispenser, wherein the first attachment means comprises at least one elongated attachment member being adapted to be arranged extending in or near the centre line of the solid roll and to fixate the adapter to the flexible web-shaped material of the solid roll through frictional engagement.

In one aspect of the present invention, the solid roll is provided with one adapter on each of the two sides.

In a further aspect of the present invention, the solid roll is provided with two adapters, whereby the first attachment means of the two adapters, respectively, comprises different numbers of elongated attachment members.

According to another aspect of the present invention, the solid roll is provided with a first adapter on one side and a second adapter on the opposite side, whereby the first attachment means of the first adapter comprises one elongated attachment member adapted to be arranged in or near the centre line of the solid roll and whereby the first attachment means of the second adapter comprises at least three elongated attachment members extending parallel to each other, which at least three elongated attachment members are arranged circumferentially and are adapted to be arranged near the centre line of the solid roll to encircle the centre line of the solid roll, and whereby the first adapter and the second adapter are adapted to be arranged such that the elongated attachment members of the second adapter encircle the elongated attachment member of the first adapter in at least a centre area of the solid roll.

According to yet another aspect of the present invention, the solid roll is provided with a first adapter on one side and a second adapter on the opposite side, whereby the second attachment means of the first adapter is a recess extending into the first attachment means, which recess is adapted to be arranged to receive a shaft affixed to a dispenser or rotatably mounted to a dispenser, and whereby the second attachment means of the second adapter is a shaft, which is adapted to be arranged extending away from the solid roll and to be rotatably mounted to a dispenser.

According to another aspect of the present invention, the solid roll is a jumbo roll, weighing at least 500 g and preferably at least 800 g.

According to still a further aspect of the present invention, the solid roll is a jumbo roll, weighing at least 1,000 g.

Another object of the present invention is to provide an adapter for a solid roll for simplifying and improving the installation and holding of a solid roll in a dispenser.

This object is achieved through an adapter for a solid roll of flexible web-shaped material, such as paper or non-woven material, which solid roll has two opposite sides, an envelope surface between the two sides and a centre line, the adapter comprising:

first attachment means for attachment to the solid roll, the first attachment means being adapted to be arranged extending into the solid roll from one of the sides, and second attachment means for attachment to a dispenser, the second attachment means being adapted to be arranged enabling attachment to a dispenser, wherein the first attachment means comprises at least one elongated attachment being adapted to be arranged extending in or near the centre line of the solid roll and to fixate the adapter to the flexible web-shaped material of the solid roll through frictional engagement.

According to one aspect of the present invention, the adapter is used for jumbo rolls, weighing at least 500 g and preferably at least 800 g.

According to a further aspect of the present invention, the adapter is used for jumbo rolls, weighing at least 1,000 g.

In further embodiments of the solid roll and the adapter according to the present invention, the adapter further comprises restriction means for restricting insertion of the adapter into the solid roll, the restriction means comprising a first side being adapted to be arranged facing and adjacent to one side of the solid roll and an opposite second side adapted to be arranged facing away from the one side of the solid roll, whereby the first attachment means for attachment to the solid roll is arranged extending from the first side of the restriction means and whereby the second attachment means for attachment to a dispenser is arranged extending from the second side of the restriction means.

In still further embodiments of the solid roll and the adapter according to the present invention, at least one of the at least one elongated attachment member comprises a portion with a tapered shape ending in a pointed distal end.

In other embodiments of the solid roll and the adapter according to the present invention, the first attachment means comprises one elongated attachment member adapted to be arranged extending in or near the centre line of the solid roll, whereby the elongated attachment member comprises a helical winding.

In further embodiments of the solid roll and the adapter according to the present invention, the first attachment means comprises at least three elongated attachment members extending parallel to each other, which at least three elongated attachment members are arranged circumferentially and are adapted to be arranged extending near the centre line of the solid roll to encircle the centre line of the solid roll.

In other embodiments of the solid roll and the adapter according to the present invention, the first attachment means comprises one centred elongated attachment member and at least two elongated attachment members extending parallel to the centred elongated attachment member and at a distance from the centred elongated attachment member.

Preferably, the second attachment means is adapted to be arranged extending in the direction of the centre line of the solid roll.

In further embodiments of the solid roll and the adapter according to the present invention, the second attachment means comprises a shaft, which is adapted to be arranged extending away from the solid roll and to be rotatably mounted to a dispenser.

In still further embodiments of the solid roll and the adapter according to the present invention, the adapter further comprises restriction means for restricting insertion of the adapter into the solid roll, the restriction means comprising a first side being adapted to be arranged facing and adjacent to one side of the solid roll and an opposite second side adapted to be arranged facing away from the one side of the solid roll, whereby the second attachment means is a recess extending into the restriction means, which recess is adapted to be arranged to receive a shaft affixed to a dispenser or rotatably mounted to a dispenser.

In other embodiments of the present invention, the second attachment means is a recess extending from an end of the adapter being arranged to face a dispenser and in the direction of the first attachment means, which recess is adapted to be arranged to receive a shaft affixed to a dispenser or rotatably mounted to a dispenser.

In further embodiments of the solid roll and the adapter according to the present invention, the second attachment means comprises a shaft, which is adapted to be arranged extending away from the solid roll and to be rotatably mounted to a dispenser, and an attachment member attached to an end of the shaft adapted to be arranged adjacent or in a dispenser, which attachment member is adapted to be arranged running parallel to said one side of the solid roll.

In still further embodiments of the solid roll and the adapter according to the present invention, the second attachment means comprises an attachment member adapted to be arranged running parallel to said one side of the solid roll, whereby said attachment member is a plate-like member.

In other embodiments of the solid roll and the adapter according to the present invention, the adapter is a screw.

The present invention further refers to a dispenser, which is arranged to hold a solid roll according to the invention by having complementary means being complementary to the second attachment means.

The present invention also refers to an adapter combination comprising a first adapter and a second adapter according to the invention, whereby the first attachment means of the first adapter and the second adapter, respectively, comprises different numbers of elongated attachment members.

The present invention further refers to an adapter combination comprising a first adapter according to the invention in which the first attachment means comprises one elongated attachment member adapted to be arranged extending in or near the centre line of the solid roll and a second adapter according to the invention in which the first attachment means comprises at least three elongated attachment members extending parallel to each other, which at least three elongated attachment members are arranged circumferentially and are adapted to be arranged extending near the centre line of the solid roll to encircle the centre line of the solid roll, wherein the first adapter and the second adapter are adapted to be arranged such that the elongated attachment members of the second adapter encircle the elongated attachment member of the first adapter in at least a centre area of the solid roll.

The present invention also refers to an adapter combination comprising a first adapter in which the second attachment means is a shaft, which is adapted to be arranged extending away from the solid roll and to be rotatably mounted to a dispenser, and a second adapter in which the second attachment means is a recess extending into the first attachment means, which recess is adapted to be arranged to receive a shaft affixed to a dispenser or rotatably mounted to a dispenser.

Still other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

In the drawings, wherein like reference characters denote similar elements throughout the several views.

DETAILED DESCRIPTION OF THE INVENTION

Figure 1A:
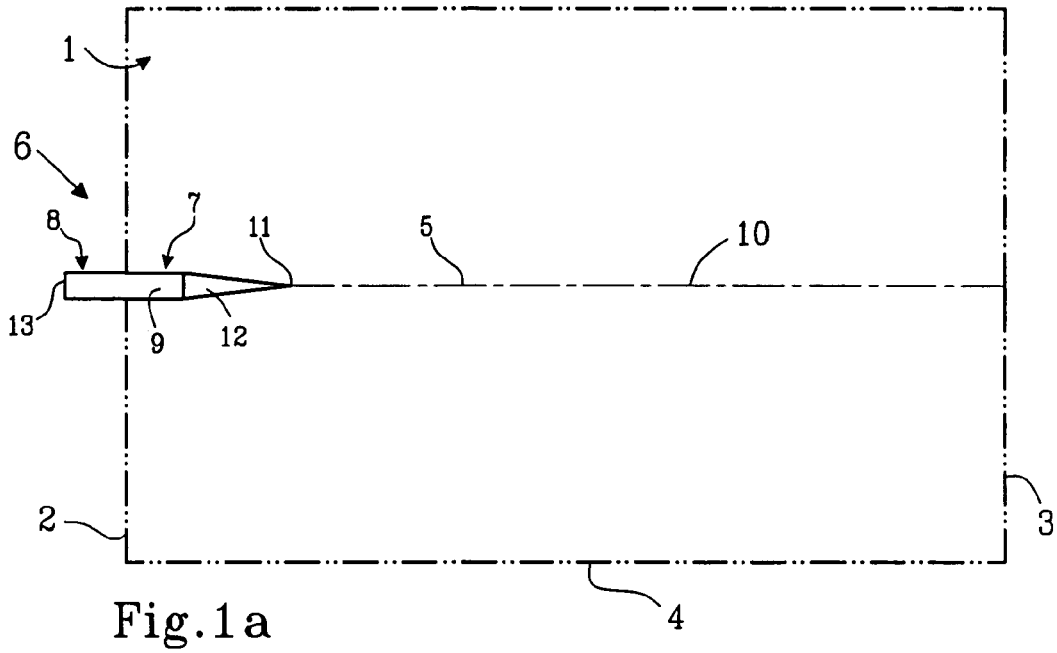
FIG. 1*a* shows a cross-sectional view of the first embodiment of a solid roll according to the invention.
Figure 1B:
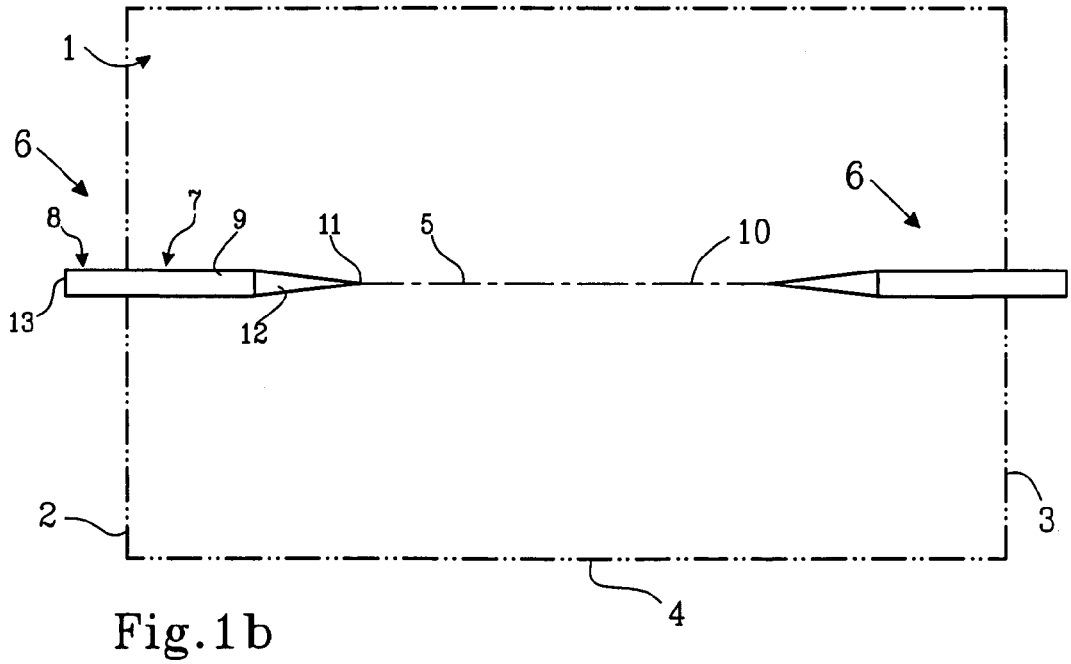
FIG. 1*b* shows a cross-sectional view of the second embodiment of the solid roll according to the invention.

FIGS. 1*a* and 1*b* show a simplified cross-sectional view of a first embodiment and a second embodiment, respectively, of a solid roll 1 of flexible web-shaped material according to the present invention, in which views the outline of the solid rolls 1 is shown with dashed lines. As mentioned above, solid rolls of flexible web-shaped material do not comprise any hollow cylindrical core as cored rolls and neither any aperture extending through the centre of the roll as coreless rolls. Instead, the innermost part of solid rolls is filled with flexible web-shaped material. The solid roll 1 according to the invention may be of any types and sizes, including jumbo rolls.

The solid roll 1, being cylinder-shaped, has two opposite sides 2, 3, an envelope surface 4 between the two sides 2, 3 and a centre line 5. If the solid roll 1 is wound properly and essentially evenly of flexible web-shaped material, the innermost winding is essentially located at the centre line 5. Usually, solid rolls are properly and essentially evenly wound of flexible web-shaped material and therefore the innermost winding is essentially located at the centre line 5 or at least near the centre line 5.

Figure 1C:
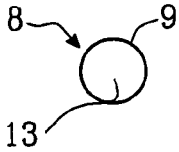
FIG. 1*c* shows a first end view of an adapter in the first and second embodiments of the solid roll according to the invention.
Figure 1D:
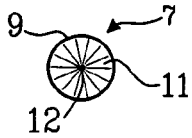
FIG. 1*d* shows a second end view of the adapter in the first and second embodiments of the solid roll according to the invention.

In accordance with the invention, the solid roll 1 is provided with at least one adapter 6, which adapter 6 is adapted to be arranged on one of the sides 2, 3. The solid roll 1 may be provided with one adapter 6 only, i.e. one adapter 6 on one of the sides 2, 3, or with two adapters 6, i.e. with one adapter 6 on each of the two sides 2, 3. In the first embodiment, which is shown in FIG. 1*a*, the solid roll 1 is provided with one adapter 6 only. In the second embodiment, which is shown in FIG. 1*b*, the solid roll 1 is provided with two adapters 6. The adapter 6 in the first embodiment and the adapters 6 in the second embodiment all have the same configuration. A first and second end view of the adapter 6 in the first and second embodiments are, respectively, shown in FIG. 1*c* and FIG. 1*d*. In other embodiments, the solid roll 1 is, however, provided with two adapters 6 having different configurations. This will be further described below.

The adapter 6 is adapted to be partly inserted into the solid roll 1 and comprises first attachment means 7 for attachment to the solid roll 1 and second attachment means 8 for attachment to a dispenser.

The first attachment means 7 for attachment of the adapter 6 to the solid roll 1 is adapted to be arranged extending into the solid roll from one side 2, 3 of the solid roll 1 and is adapted to engage the solid roll 1 in or near its centre line 5.

The second attachment means 8 for attachment of the adapter 6 to a dispenser is adapted to be arranged enabling attachment to a dispenser. Preferably, the second attachment means 8 is adapted to be arranged extending in the direction of the centre line 5 of the solid roll 1. The second attachment means 8 is adapted to allow attachment of the adapter 6 to various types of conventional dispensers including conventional dispensers for cored rolls as well as dispensers intended for solid and coreless rolls being provided with depressions in their sides. In the first and second embodiments of the solid roll 1, the second attachment means 8 comprises a shaft 13, which is adapted to be arranged extending away from the solid roll 1 and to be rotatably mounted to complementary means in a dispenser. Examples of complementary means in a dispenser to which the shaft 13 may be mounted are different types of bearings. However, as will be further described below, the shape of the second attachment means 8 may be varied in further embodiments in order to fit to different complementary means in different types of conventional dispensers. In some cases it might also be possible to change the complementary means in a conventional dispenser in order to fit to the second attachment means 8.

Furthermore, the first attachment means 7 of the adapter 6 in the first and second embodiments comprises one elongated attachment member 9, which for example has the shape of a pin, tube or the like and which is adapted to be arranged extending in or near the centre line 5 of the solid roll 1. The elongated attachment member 9 is adapted to fixate the adapter 6 to the flexible web-shaped material of the solid roll 1 through frictional engagement. Even if the first attachment means 7 of the adapter 6 in the first and second embodiments of the solid roll 1 comprises one elongated attachment member 9, the adapter 6 may in other embodiments of the solid roll 1 comprise more than one elongated attachment member 9. Other embodiments of the present invention, in which the adapter 6 comprises more than one elongated attachment member 9 adapted to be arranged to extend in or near the centre line of the solid roll 1 will be further described below.

The elongated attachment member 9 is adapted to be inserted into the solid roll 1 between windings of flexible web-shaped material since even the innermost part of the solid roll 1 is filled with material. If the solid roll 1 is essentially evenly wound with flexible web-shaped material, which it usually is, then the centre line 5 of the solid roll 1 coincides at least essentially with the rotational axis of the solid roll 1. However, after insertion of the elongated attachment member 9 into the solid roll 1, the second attachment means 8 defines a rotational centre line 10 for the solid roll 1, around which the solid roll 1 will rotate when held in a dispenser.

In order to be able to unwind and use all or essentially all flexible web-shaped material of the solid roll 1, it is important that the elongated attachment member 9 is inserted in or near the innermost winding. Since solid rolls usually are properly and essentially evenly wound of flexible web-shaped material, and the innermost winding therefore is essentially located at the centre line 5 or at least near the centre line 5, it is important that the elongated attachment member 9 is inserted in or near the centre line 5 of the solid roll 1. In the first and second embodiments, the elongated attachment member 9 is preferably inserted essentially along the centre line 5 of the solid roll 1 and most preferably along the centre line 5 of the solid roll 1.

Since even the innermost part of the solid roll 1 is filled with material, the elongated attachment member 9 must be forced to penetrate into the solid roll 1. In the first and second embodiments, the elongated attachment member 9 comprises a portion 12 with a tapered shape ending in a pointed distal end 11 in order to facilitate the penetration of the elongated attachment member 9 into the solid roll 1. The portion 12 having a tapered shape may constitute only a part of the elongated attachment member 9 or the complete elongated attachment member 9. The tapering of the portion 12 having a tapered shape may be gradual or stepwise to the pointed distal end 11. The adapter 6 is inserted with the pointed distal end 11 first, which may be sharply pointed. However, in other embodiments the elongated attachment member 9 does not comprise a tapered portion 12 nor a pointed distal end 11. Furthermore, in still other embodiments comprising more than one elongated attachment member 9, only one or some of the elongated attachment members 9 comprise a tapered portion 12 and a pointed distal end 11.

The pointed distal end 11 and the tapered portion 12 ease insertion of the elongated attachment member 9 and reduce the force required for insertion. Nevertheless, the insertion of the elongated attachment member 9 requires that a relatively high pressure is applied. Furthermore, at insertion of the elongated attachment member 9 of the adapter 6 into the solid roll 1 it is important, as above described, that the elongated attachment member 9 is inserted near or in the centre line of the solid roll 1 in order to be able to unwind and use essentially all flexible web-shaped material. If two adapters 6 are to be inserted into the solid roll 1, it is also important that the elongated attachment members 9 of the two adapters 6, respectively, are essentially aligned such that the rotational centre line 10 that the second attachment means 8 of the two adapters 6, respectively, defines will be essentially the same line in the solid roll 1. Therefore, the insertion of the adapter 6 is preferably performed at the time of manufacture of the solid roll 1 or at least before the solid roll 1 reaches the end consumer. By performing the insertion of the adapter 6 at a factory, the insertion may be performed under controlled circumstances. For example, a force that is high enough, but not too high, may then be applied for the insertion of the adapter 6 into the solid roll 1, suitable means may be applied for the insertion and the insertion may be controlled to be performed such that the elongated attachment member 9 is inserted in or near the centre line of the solid roll 1. Furthermore, by performing the insertion of the adapter 6 into the solid roll 1 before the solid roll 1 reaches the end consumer, a kit with the solid roll 1 provided with one or two adapters 6 may be delivered to the end consumer. This implies that the solid roll 1 is ready for use at delivery, i.e. that the user does not have to apply any adapter(s) before loading in a dispenser. Thereby, the end consumer does not have to deal with the difficulties concerning insertion of the adapter(s) 6 into the solid roll 1, concerning fitting of the adapter(s) 6 such that the adapter(s) 6 is/are inserted in or near the centre line of the solid roll and, if two adapters 6 are to be used, concerning alignment of the two adapters 6.

Preferably, the elongated attachment member 9 has a circular cross-section, but the cross-section may also have other shapes, such as for example oval, triangular, rectangular or star-shaped. The elongated attachment member 9 could also have a central body with a plurality of pins protruding from it. The length and the diameter of the elongated attachment member 9 must be suited for holding the solid roll 1 securely and for delaying collapse when there are only a few windings left of material of the solid roll 1.

Preferably, the adapter 6 is produced of a metal, such as steel, aluminium alloys etc. However, other materials like for example plastic materials or pressed wood may also be used. The adapter 6 is relatively easy to produce and may be produced at a relatively low material cost. Furthermore, the adapter 6 is preferably disposable, but may also be non-disposable.

The adapter 6 in the first and the second embodiments of the solid roll 1 has, as may be seen in FIGS. 1*a*-1*d*, the shape of a pin or the like, whereby one end part constitutes the first attachment means 7 and the other end part constitutes the second attachment means 8. In order to enable reliable attachment of the adapter 6 to the solid roll 1, the end part constituting the first attachment means 7 must then be positioned within the solid roll 1 such that reliable attachment of the adapter 6 to the solid roll 1 is achieved. Furthermore, the end part constituting the second attachment means 8 must then be positioned outside the solid roll 1 such that reliable attachment to a dispenser may be achieved.

Figure 2:
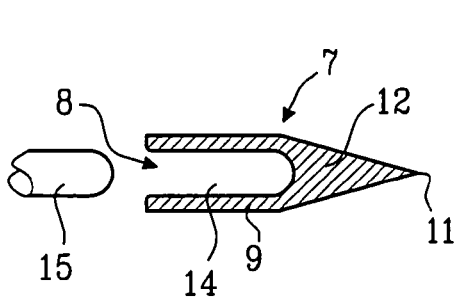
FIG. 2 shows a cross-sectional side view of the adapter in the third and fourth embodiments of the solid roll according to the invention.

A third embodiment of the solid roll 1 according to the invention is similar to the first embodiment of the solid roll 1 except concerning the second attachment means 8 of the adapter 6. In the third embodiment of the solid roll 1, the second attachment means 8 is a recess 14, which extends from an end 22 of the adapter 6 being adapted to face a dispenser and in the direction of the first attachment means 7. In the third embodiment, the recess 14 extends into the first attachment means 7. However, in other embodiments the recess does not extend into the first attachment means 7. The recess 14 is adapted to be arranged to receive a shaft 15 rotatably mounted to a dispenser. The adapter 6 of the solid roll 1 in the third embodiment is shown in FIG. 2 in a cross-sectional side view together with the shaft 15. In the third embodiment, the solid roll 1 is provided with one adapter 6 having the configuration shown in FIG. 2, whereas in a fourth embodiment, the solid roll 1 is provided with two adapters 6 having the configuration shown in FIG. 2.

A fifth embodiment of the solid roll 1 according to the invention is similar to the first embodiment of the solid roll 1 except concerning that the adapter 6 further comprises restriction means 16 for restricting the insertion of the adapter 6 into the solid roll 1. The adapter 6 in the fifth embodiment is shown in a side view in FIG. 3*a*, a first end view in FIG. 3*b* and a second end view in FIG. 3*c*. The restriction means 16 is arranged to restrict the insertion of the adapter 6 into the solid roll 1 above all in order to enable a reliable attachment of the adapter 6 to a dispenser by the second attachment means 8. Thus, as will be described further below, the restriction means 16 prevents the adapter 6 from being inserted into the solid roll 1 to such an extent that the second attachment means 8 is located at a position in which attachment to a dispenser can not be achieved or can not be achieved in a reliable way. Therefore, the restriction means 16 has a size and a shape, which prevent the restriction means 16 from being inserted into the solid roll 1 and the adapter 6 is thus permitted to be inserted into the solid roll 1 until the restriction means 16 is located adjacent one side 2, 3 of the solid roll 1. For example, a plate having a form that is circular, oval, triangular or rectangular may constitute the restriction means 16.

The restriction means 16 comprises a first side 16*a*, which is adapted to be arranged facing one side 2, 3 of the solid roll 1 and to be adjacent that side 2, 3 of the solid roll 1, and an opposite second side 16*b*, which is adapted to be arranged facing away from the side 2, 3, which the first side 16*a* is arranged to face. Thus, the second side 16*b* is adapted to be arranged facing a dispenser when the solid roll 1 is installed and held in the dispenser.

In the adapter 6 in the fifth embodiment of the solid roll 1, the first attachment means 7 for attachment to the solid roll 1 is arranged extending from the first side 16*a* of the restriction means 16 and the second attachment means 8 for attachment to a dispenser is arranged extending from the second side 16*b* of the restriction means 16. The first attachment means 7 is essentially centred on the first side 16*a* of the restriction means 16 and extends essentially from the centre of the first side 16*a* of the restriction means 16. In order to enable smooth rotation of the solid roll 1 around the rotational centre line 10, which as mentioned above is defined by the second attachment means 8, the second attachment means 8 is essentially aligned with the first attachment means 7. Therefore, the second attachment means 8 is, in accordance with the first attachment means 7, preferably centred on the restriction means 16 and extends preferably essentially from the centre of the second side 16*b* of the restriction means 16. Furthermore, the first and second attachment means are, respectively, fixedly attached to the restriction means 16.

Figure 3A:
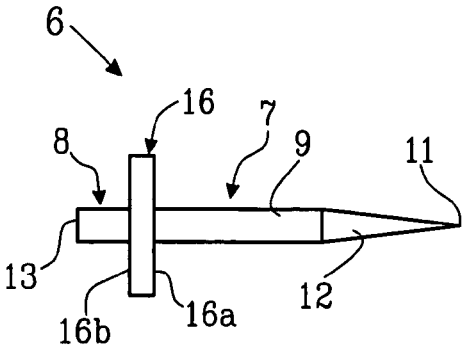
FIG. 3*a* shows a side view of the adapter in the fifth and sixth embodiments of the solid roll according to the invention.
Figure 3B:
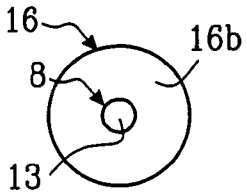
FIG. 3*b* shows a first end view of the adapter according to FIG. 3*a*.
Figure 3C:
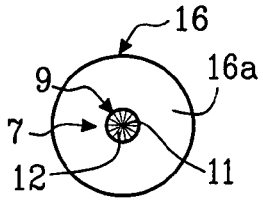
FIG. 3*c* shows a second end view of the adapter according to FIG. 3*a*.
Figure 3D:
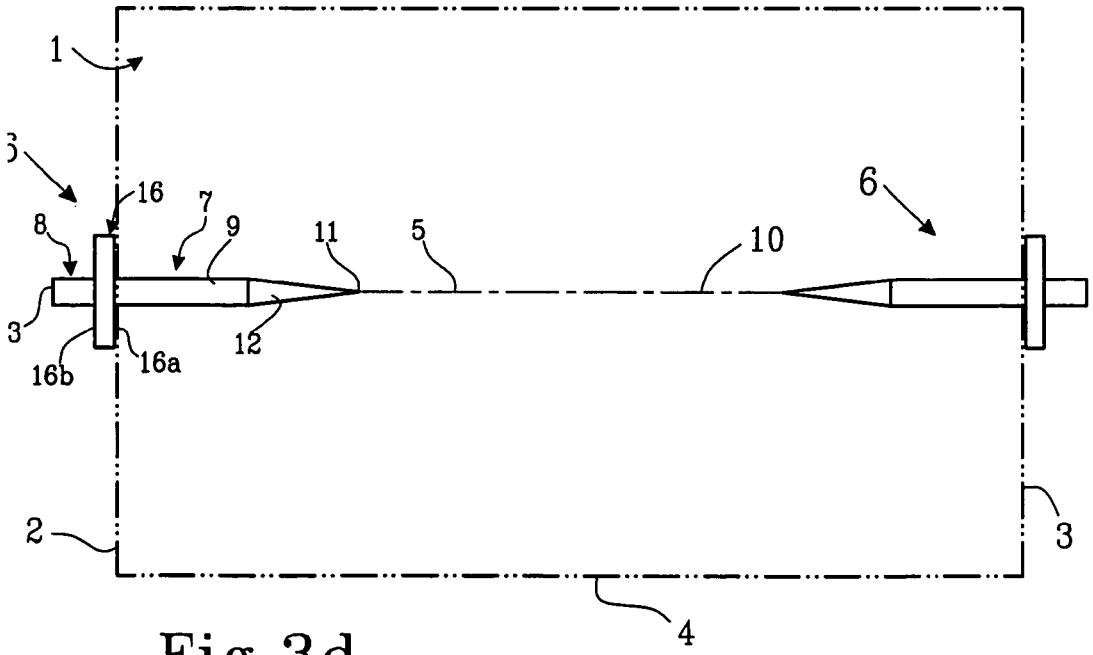
FIG. 3*d* shows a cross-sectional view of the sixth embodiment of the solid roll according to the invention.

In the fifth embodiment, the solid roll 1 is provided with one adapter 6 having the configuration shown in FIG. 3*a-c*, whereas in a sixth embodiment, the solid roll 1 is provided with two adapters 6 having the configuration shown in FIG. 3*a-c*. A simplified cross-sectional view of the sixth embodiment of the solid roll 1 is shown in FIG. 3*d*, in which view the outline of the solid roll 1 is shown with dashed lines.

A dispenser 17 according to the invention is arranged to hold the solid roll 1 according to the invention by having complementary means 18 that are complementary to the second attachment means 8. Thus, the dispenser 17 according to the invention can either be arranged to hold a solid roll 1 being provided with only one adapter 6 on one side 2, 3 or to hold a solid roll 1 being provided with one adapter 6 on each side 2, 3. The adapter 6 according to the invention is arranged to adapt the solid roll 1 to be dispensed in various types of conventional dispensers having different configurations. However, a detailed explanation of the frame and other components of dispensers in which the solid 1 according to the present invention may be dispensed, is not necessary for the purpose of the present disclosure.

Figure 4:
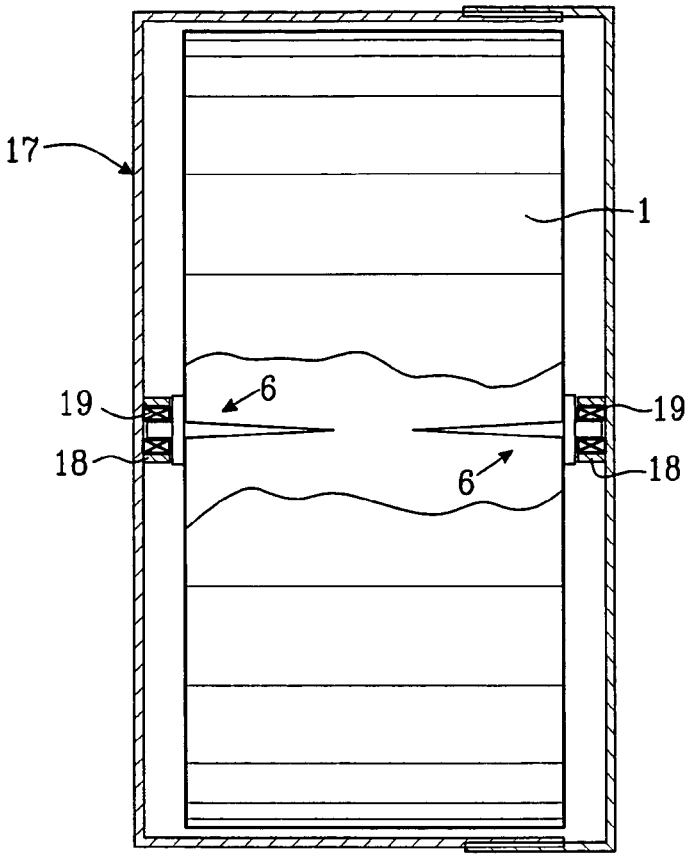
FIG. 4 shows a schematic cross-sectional view of a dispenser according to the invention holding the solid roll according to the sixth embodiment.

FIG. 4 shows a schematic cross-sectional view of a dispenser 17 according to the invention holding the solid roll 1 of the sixth embodiment according to the invention. Thus, the solid roll 1 in FIG. 4 is provided with one adapter 6 on each side 2, 3. The dispenser 17 is provided with complementary means 18 that are complementary to the second attachment means 8 of the adapter 6. In order to suit for the second attachment means 8 of the adapter 6 in the sixth embodiment of the solid roll 1, which is one shaft 13, the complementary means 18 is, for example, a bearing 19 provided on each side of the dispenser 17 adapted to face the solid roll 1 held in the dispenser 17. The shaft 13 is then rotatably mounted in the bearing 19. When the solid roll 1 is installed in the dispenser 17 it is held securely in the dispenser 17 by the elongated attachment member 9 and the shaft 13 of each of the two adapters 6 and is able to rotate freely in the two bearings 19.

The bearing 19 is preferably a roller bearing, but different kinds of bearings can be used, such as ball bearings, needle bearings and plain bearings of the self-lubricating type for example produced of nylon. Preferred are the types of bearings that will give a certain stability to the first and second attachment means 7, 8, such as roller, needle and plain bearings. In a dispenser 17 according to the invention being adapted to hold one solid roll 1 with only one adapter 6 provided on one side 2, 3, the bearing 19 will have to withstand the momentum from the solid roll 1 on the first attachment means 7 and second attachment means 8. Furthermore, in a dispenser 17 according to the invention being adapted to hold one solid roll 1 with one adapter 6 provided on each side 2, 3 of the solid roll 1 and thus being provided with two bearings 19, the bearings 19 will have to withstand momentum from the solid roll 1 on the first attachment means 7 and the second attachment means 8 during the installation of the solid roll 1 when the solid roll 1 might for a while only be mounted to one of the bearings 19.

A dispenser 17 according to the invention arranged to hold the solid roll 1 according to the invention provided with one or two adapters 6 having a recess 14 as second attachment means 8 comprises one or two shafts 15 as the complementary means 18.

Figure 5A:
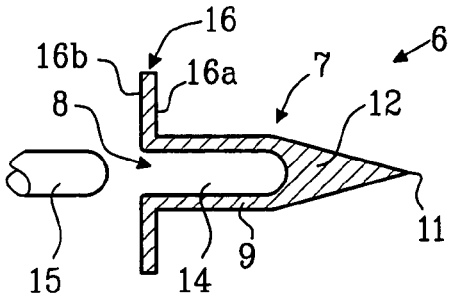
FIG. 5*a* shows a cross-sectional side view of the adapter in the seventh and eighth embodiments of the solid roll according to the invention.
Figure 5B:
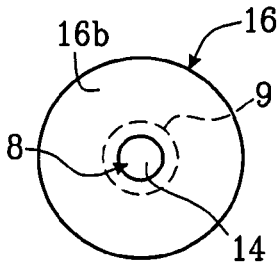
FIG. 5*b* shows a first end view of the adapter according to FIG. 5*a*.
Figure 5C:
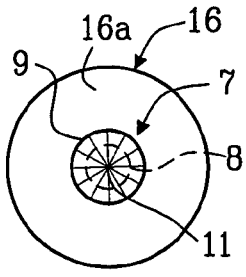
FIG. 5*c* shows a second end view of the adapter according to FIG. 5*a*.

A seventh embodiment of the solid roll 1 is similar to the fifth embodiment except for concerning the second attachment means 8 of the adapter 6. The second attachment means 8 in the seventh embodiment is similar to the second attachment means 8 in the third embodiment, i.e. it is a recess 14. In the seventh embodiment, the recess 14 extends from the end 22 of the adapter 6 being adapted to face a dispenser through the restriction means 16 and into the first attachment means 7. The adapter 6 in the seventh embodiment is shown in a cross-sectional side view in FIG. 5*a*, a first end view in FIG. 5*b* and a second end view in FIG. 5*c*. In the seventh embodiment, the solid roll 1 is provided with one adapter 6 having the configuration shown in FIG. 5*a-c*, whereas in an eighth embodiment, the solid roll 1 is provided with two adapters 6 having the configuration shown in FIG. 5*a-c*.

Figure 6A:
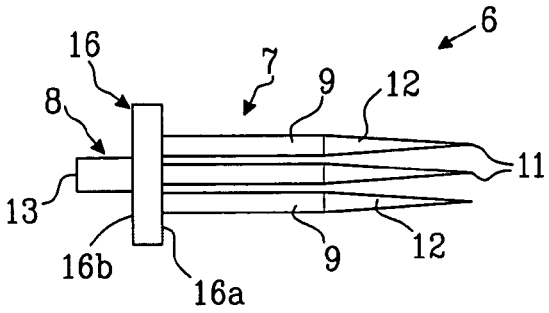
FIG. 6*a* shows a side view of the adapter in the ninth and tenth embodiments of the solid roll according to the invention.
Figure 6B:
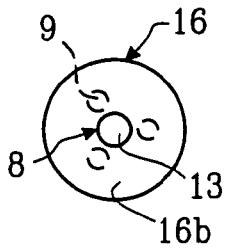
FIG. 6*b* shows a first end view of the adapter according to FIG. 6*a*.
Figure 6C:
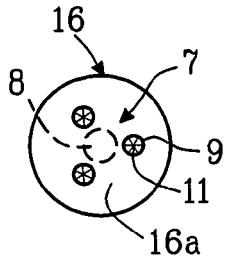
FIG. 6*c* shows a second end view of the adapter according to FIG. 6*a*.
Figure 6D:
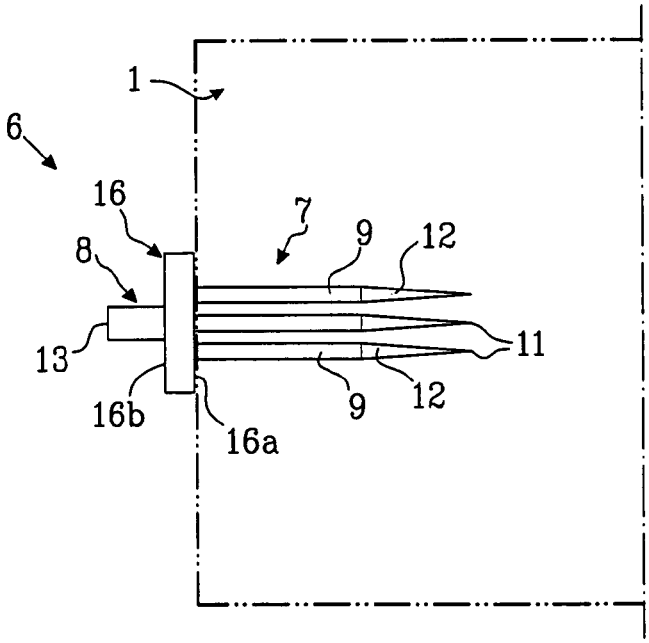
FIG. 6*d* shows a cross-sectional view of the ninth embodiment of the solid roll according to the invention.

A ninth embodiment of the solid roll 1 is similar to the fifth embodiment except for concerning the first attachment means 7 of the adapter 6. In the ninth embodiment the first attachment means 7 comprises three elongated attachment members 9, which are extending essentially parallel to each other. The three elongated attachment members 9 are arranged circumferentially and are adapted to be arranged extending near the centre line 5 of the solid roll 1 to encircle the centre line 5 of the solid roll 1. The adapter 6 in the ninth embodiment is shown in a side view in FIG. 6*a*, a first end view in FIG. 6*b* and a second end view in FIG. 6*c*. The ninth embodiment of the solid roll 1 is shown in a cross-sectional view in FIG. 6*d*, whereby the solid roll 1 is provided with one adapter 6 having the configuration shown in FIG. 6*a-c*. In a tenth embodiment, the solid roll 1 is provided with two adapters 6 having the configuration shown in FIG. 6*a-c*.

An eleventh embodiment and a twelfth embodiment of the solid roll 1 (not shown) are respectively similar to the first embodiment and the second embodiment of the solid roll 1 except for concerning the first attachment means 7 of the adapter 6. In the eleventh and twelfth embodiment, the first attachment means 7 is similar to the first attachment means 7 in the ninth and tenth embodiment, respectively.

Figure 7A:
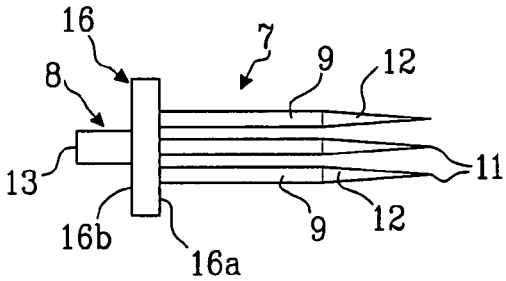
FIG. 7*a* shows a side view of an alternative adapter.
Figure 7B:
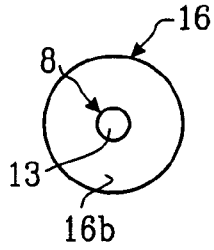
FIG. 7*b* shows a first end view of the adapter according to FIG. 7*a*.
Figure 7C:
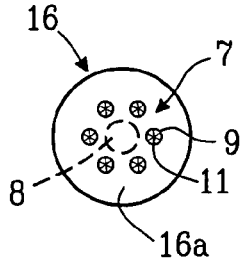
FIG. 7*c* shows a second end view of the adapter according to FIG. 7*a*.

In other embodiments of the solid roll 1, the adapter 6 may comprise more than three elongated attachment members 9 arranged circumferentially and adapted to be arranged near the centre line 5 of the solid roll 1 to encircle the centre line 5 of the solid roll 1. One example of such an adapter 6, which has six elongated attachment members 9, is shown in a side view in FIG. 7*a*, a first end view in FIG. 7*b* and a second end view in FIG. 7*c*.

In alternatives (not shown) of embodiments in which the adapter 6 comprises more than one elongated attachment member 9, the first attachment means 7 further comprises a central body 20, whereby the elongated attachment members 9 protrude from the central body 20. The second attachment means may be a recess 14, which extends into the central body 20 of the first attachment means 7.

Further alternatives of embodiments of the solid roll 1 are similar to any of the above described embodiments except for concerning the first attachment means 7. In the further alternatives, the first attachment means 7 comprises one centred elongated attachment member 9 and at least two elongated attachment members 9 extending parallel to the centred elongated attachment member 9 and at a distance from the centred elongated attachment member 9. The elongated attachment members 9 extending parallel with the centred elongated attachment member 9 may be arranged, for example, in a row together with the centred elongated attachment member 9, in a circle around the centred elongated attachment member 9, at corners of a triangle, at corners of a square etc. However, other arrangements of the elongated members 9 are also possible. Furthermore, the elongated attachment members 9 may have different lengths, whereby, for example, the centred elongated attachment member 9 may be longer than the other elongated attachment members 9.

Figure 8:
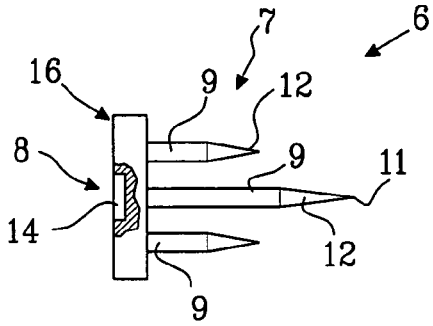
FIG. 8 shows a side view of another alternative adapter.

One example of an embodiment in which the first attachment means 7 comprises one centred elongated attachment member 9 and two elongated attachment members 9 extending parallel to the centred elongated attachment member 9 and arranged in a row together with the centred elongated attachment member 9, in which restriction means 16 is comprised and in which the second attachment means 8 is a recess 14 extending into the restriction means 16 is shown in a side view in FIG. 8.

Still further alternatives of embodiments of the solid roll 1 are similar to any of the above described first, second, fifth or sixth embodiments except for concerning the second attachment means 8. In the still further embodiments, the second attachment means 8 further comprises, except for the shaft 13, an attachment member 21 attached at an end 28 of the shaft 13 being adapted to be arranged adjacent or in a dispenser. The attachment member 21 is adapted to be arranged running parallel to the side 2, 3 of the solid roll 1 and may be adapted to be arranged at a distance from the side 2, 3 of the solid roll 1 or near or adjacent the side 2, 3. Preferably, the attachment member 21 is a plate-like member, which, for example, is circular. The solid roll 1 according to any of the still further embodiments may, for example, be inserted into a dispenser having an inner wall and an outer wall on each dispenser side to which the solid roll 1 is to be attached and a notch in the inner wall. The shaft 13 is then inserted into the notch in the inner wall and the attachment member 21 is positioned between the inner wall and the outer wall. If the adapter 6 in such a still further embodiment also comprises a restriction means 16, the restriction means 16 and the attachment member 21 run parallel to each other.

Figure 9A:
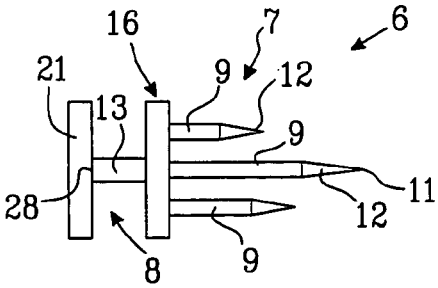
FIG. 9*a* shows a side view of a further alternative adapter.
Figure 9B:
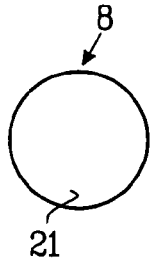
FIG. 9*b* shows a first end view of the adapter according to FIG. 9*a*.
Figure 9C:
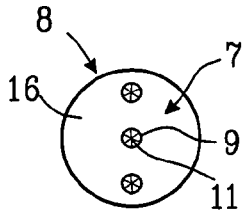
FIG. 9*c* shows a second end view of the adapter according to FIG. 9*a*.

One example of an embodiment in which the second attachment means 8 comprises a shaft 13 and an attachment member 21 being a circular plate and in which the first attachment means 7 comprises one centred elongated attachment member 9 and two elongated attachment members 9 extending parallel to the centred elongated attachment member 9 and at a distance from the centred elongated attachment member 9 is shown in a side view in FIG. 9*a*, a first end view in FIG. 9*b* and a second end view in FIG. 9*c*.

Yet further alternatives of embodiments of the solid roll 1 are similar to any of the first through eighth embodiments, i.e. similar to embodiments in which the adapter 6 comprises one elongated attachment member 9, except for concerning that the elongated attachment member 9 further comprises a helical winding 23 on its outer surface. The helical winding 23 may be wound in a right or left direction and may have any suitable pitch. If an adapter 6 comprises a helical winding 23, it is inserted into the solid roll 1 by a screwing process.

If a solid roll 1 comprises two adapters 6 having one elongated attachment member 9 comprising a helical winding 23, the direction of the helical winding 23 of the two adapters 6, respectively, may be the same or different. Thus, a solid roll 1 may comprise one adapter 6 with a helical winding 23 in a left direction and one adapter 6 with a helical winding 23 in a right direction. Preferably, but not necessarily, the adapter 6 has such a helical winding 23 that it may be screwed into the solid roll 1 against the direction of the winding of the flexible web-shaped material of the solid roll 1.

In additional embodiments of the solid roll 1, the adapter 6 is a screw 24. Then the second attachment means 8 comprises the head 25 of the screw 24 and the first attachment means 7 comprises the part of the screw with a helical winding 23. The screw 24 may be any type of standard screw, but is preferably a specially designed screw having, for example, a specially designed head 25 such that mounting to a dispenser is enabled and facilitated. Furthermore, the screw 24 may comprise engagement means 26 for advancement into the solid roll 1. The engagement means 26 for advancement into the solid roll 1 may, for example, be a star-shaped or cross-shaped recess in the head of the screw. The helical winding 23 may be wound in a right or left direction and may have any suitable pitch.

Figure 10A:
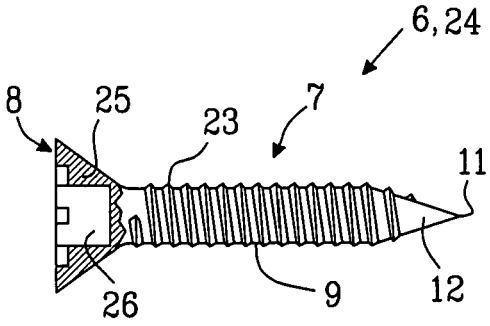
FIG. 10*a* shows a side view of yet an alternative adapter.
Figure 10B:
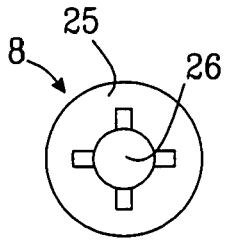
FIG. 10*b* shows a first end view of the adapter according to FIG. 10*a*.
Figure 10C:
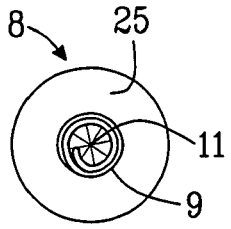
FIG. 10*c* shows a second end view of the adapter according to FIG. 10*a*.

In some of the additional embodiments of the solid roll 1, in which the adapter 6 is a screw 24, the second attachment means 8 of the screw 24 further comprises a recess 14 that extends through the engagement means 26 and at least partially into the head 25 of the screw 24 in the direction of the first attachment means 7. Optionally, the recess 14 may also extend into the first attachment means 7. An example of an adapter 6, which is a screw 24 and which is provided with a recess 14, is shown in a side view in FIG. 10*a*, in a first end view in FIG. 10*b* and in a second end view in FIG. 10*c*.

In some other of the additional embodiments of the solid roll 1, in which the adapter 6 is a screw 24, the second attachment means 8 of the screw 24 further comprises a shaft attached to the screw head 25 and adapted to be mounted to a dispenser.

The solid roll 1 may be a compact type of solid roll having a density of about 250-380 kg/m$^3$ or a more loosely wound type of solid roll having a density of about 140-250 kg/m$^3$. If the adapter 6 comprises one elongated attachment member 9, the length of the elongated attachment member 9 is preferably about 5-20 mm if the solid roll 1 is a compact type of solid roll and about 5-50 mm if the solid roll 1 is a more loosely wound type of solid roll. However, if the adapter 6 comprises more than one elongated attachment member 9, the length of the elongated attachment members 9 may be about 2-5 mm if the solid roll 1 is a compact type of solid roll and about 5-8 mm if the solid roll 1 is a more loosely wound type of solid roll.

If the adapter 6 of the solid roll 1 according to the invention comprises more than one elongated attachment member 9, they may have different lengths.

Even if the above described embodiments in which the solid roll 1 is provided with two adapters 6, all are embodiments in which the solid roll 1 is provided with two adapters 6 having the same configuration, the solid roll 1 according to the invention may also be provided with two adapters 6 having different configurations. Then any combinations of the above mentioned adapters 6 are possible. For example, the solid roll 1 may be provided with two adapters 6 that comprises different numbers of elongated attachment members 9, with one adapter 6 comprising the restriction means 16 and one adapter 6 without the restriction means 16 or with one adapter 6 in which the elongated attachment member 9 comprises a helical winding 23 and one adapter 6 in which the elongated attachment member 9 does not comprise a helical winding 23.

When a solid roll 1 according to the invention is provided with one adapter 6 on each side 2, 3, the two adapters 6 have usually the same type of second attachment means 8. For example, the two adapters 6 have both recesses 14 as second attachment means 8 or the two adapters 6 have both shafts 13 as second attachment means 8. However, a solid roll 1 according to the invention may also be provided with one adapter 6 having a recess 14 as second attachment means 8 and one adapter 6 having a shaft 13 as second attachment means 8. Then the stacking of the solid rolls 1 for transport or storage in a packaging box is facilitated, since the shaft 13 of one solid roll 1 may be fitted into the recess 14 of another solid roll 1.

Figure 11:
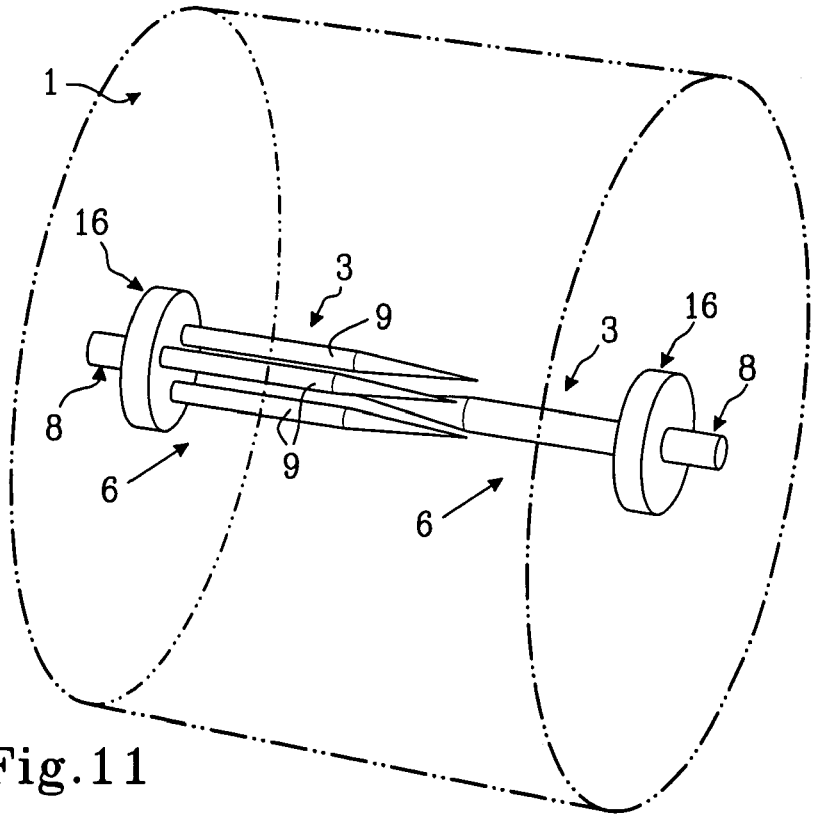
FIG. 11 shows a cross-sectional view of a solid roll being provided with a first adapter and a second adapter.

Furthermore, since solid rolls have no core there might be a risk that a solid roll collapses when there are only a few windings of material left of the solid roll. In order to avoid collapse, it might therefore be desirable or necessary that the solid roll 1 is provided with one adapter 6 on each side 2, 3, which adapters 6 have elongated attachment members 9 overlapping each other in at least the centre area of the solid roll 1. For example, the solid roll 1 may, which is shown in a cross-sectional view in FIG. 11, be provided with a first adapter 6 wherein the first attachment means 7 comprises one elongated attachment member 9 and a second adapter 6 wherein the first attachment means 7 comprises at least three elongated attachment members 9, whereby the first adapter 6 and the second adapter 6 are adapted to be arranged such that the elongated attachment members 9 of the second adapter 6 encircle the elongated attachment member 9 of the first adapter 6 in at least a centre area of the solid roll 1. A combination of a first adapter 6 and a second adapter 6 may of course also comprise adapters 6 having other numbers of elongated attachment members than those numbers mentioned. For example, the first adapter 6 may comprise three elongated attachment members 9 and the second adapter 6 may comprise six elongated attachment members 9. Furthermore, the second attachment means 8 of the adapters 6 in such a combination may be similar or different.

The solid roll 1 may, for example, be a jumbo roll. The jumbo roll may, for example, weigh at least 500 g, preferably at least 800 g and most preferably at least 1,000 g.

The present invention also relates to an adapter 6 for a solid roll, which adapter 6 is the adapter that has been described above in the kit of the solid roll 1 and at least one adapter 6.

Thus, while there have been shown and described and pointed out fundamental novel features of the invention as applied to preferred embodiments thereof, it will be understood that various omissions and substitutions and changes in the form and details of the devices illustrated, and in their operation, may be made by those skilled in the art without departing from the spirit of the invention. For example, the first attachment means may comprise other numbers of elongated attachment members than those mentioned. The first attachment means may also comprise further structures than only elongated attachment members. The shape of the second attachment means may also be varied in order to allow for attachment to various types of dispensers. Accordingly, the complementary means of the dispenser may also be varied in order to be suited for the second attachment means. Furthermore, it is expressly intended that all combinations of those elements which perform substantially the same function in substantially the same way to achieve the same results are within the scope of the invention. Moreover, it should be recognized that structures and/or elements shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

The invention claimed is:

1. A solid roll of flexible web-shaped material, said solid roll comprising:

two opposite sides;

an envelope surface between the two sides and a center line; and at least one adapter extending into the roll and secured to the roll through frictional engagement, said at least one adapter being adapted to be attached to a dispenser and having a tapered end that terminates in a point disposed axially within the roll, wherein said at least one adapter is force fitted axially into the roll with said tapered end in contact with said web-shaped material.

2. The solid roll according to claim 1, wherein the at least one adapter is fitted to the roll before delivery so that the roll including the at least one adapter is ready to be utilized in a local dispenser.

3. The solid roll according to claim 1, wherein said tapered end is a solid cone.

4. The solid roll according to claim 1, there being two said adapters one extending through each of said two sides and each extending in the direction of the other.

5. The solid roll according to claim 4, wherein said adapters terminate short of each other within the roll.

6. The solid roll according to claim 4, wherein said points of said adapters are spaced from each other.

7. The solid roll according to claim 1, there being an adapter that is in the form of at least three elongated attachment members extending parallel to each other and arranged circumferentially near but spaced from said center line, said at least three attachment members terminating inwardly of said roll in points.

8. The solid roll according to claim 1, there being a recess in an end of said at least one adapter outside the roll to receive means to rotate the roll by the application of torque within said recess.

9. The solid roll according to claim 1, wherein the roll is ready to be loaded in the dispenser at delivery without adding or fitting any adaptation parts.

10. The solid roll according to claim 1, wherein the at least one adapter includes a first means for attachment positioned within the roll and a second means for attachment configured for reliable attachment to the dispenser.

11. The solid roll according to claim 10, wherein the second means for attachment is a recess adapted to receive a shaft.

12. The solid roll according to claim 11, wherein the at least one adapter includes a first means for attachment centered on and fixably attached to the first side of the means for restriction and a second attachment means centered on and fixably attached to the second side of the means for restriction.

13. The solid roll according to claim 11, wherein the at least one adapter includes a first means for attachment centered on and fixably attached to the first side of the means for restriction and a second means for attachment configured for reliable attachment to the dispenser.

14. The solid roll according to claim 13, wherein the second means for attachment means is a recess adapted to receive a shaft.

15. The solid roll according to claim 13, wherein the second means for attachment is a recess adapted to receive a shaft, and the recess extends into the first means for attachment.

16. The solid roll according to claim 10, wherein the second means for attachment is a recess adapted to receive a shaft, and the recess extends into the first means for attachment.

17. The solid roll according to claim 10, wherein the at least one adapter includes means for restricting insertion of the adapter into the roll, the means for restriction including a first side configured to face a side of the roll and a second side configured to face the dispenser when the roll is installed.

18. A solid roll of flexible web-shaped material, said solid roll comprising:

two opposite sides;

an envelope surface between the two sides and a center line; and at least one adapter extending into the roll and secured to the roll through frictional engagement, said at least one adapter being adapted to be attached to a dispenser and having a tapered end that terminates in a point disposed axially within the roll, there being a helical screw thread on said at least one adapter a distance from said point, wherein said at least one adapter is force fitted axially into the roll with said tapered end in contact with said web-shaped material.

19. A roll assembly, comprising:

a solid roll of flexible web-shaped material, said solid roll having two opposite sides, an envelope surface between the two sides and a center line; and at least one adapter extending into the roll and secured to the roll through frictional engagement, said at least one adapter being adapted to be attached to a dispenser and having a tapered end that terminates in a point disposed axially within the roll, said at least one adapter being force fitted axially into the roll with said tapered end in contact with said web-shaped material, the at least one adapter being fitted to the roll before delivery so that the roll including the at least one adapter is ready to be utilized in a local dispenser, and the assembly is ready to be loaded in the dispenser at delivery without adding or fitting any adaptation parts.

20. The roll assembly according to claim 19, wherein the at least one adapter includes a first attachment part positioned within the roll and a second attachment part configured for reliable attachment to the dispenser, and the second attachment part is a recess adapted to receive a shaft.

21. A roll assembly, comprising:

a solid roll of flexible web-shaped material, said solid roll having two opposite sides, an envelope surface between the two sides and a center line; and at least one adapter extending into the roll and secured to the roll through frictional engagement, said at least one adapter being adapted to be attached to a dispenser and having a tapered end that terminates in a point disposed axially within the roll, said at least one adapter being force fitted axially into the roll with said tapered end in contact with said web-shaped material, the at least one adapter including a first attachment part positioned within the roll and a second attachment part configured for reliable attachment to the dispenser, and the second attachment part is a recess adapted to receive a shaft, the at least one adapter being fitted to the roll before delivery so that the roll including the at least one adapter is ready to be utilized in a local dispenser, and the assembly is ready to be loaded in the dispenser at delivery without adding or fitting any adaptation parts.

* * * * *